US006817707B1

(12) United States Patent
Fowler et al.

(10) Patent No.: US 6,817,707 B1
(45) Date of Patent: Nov. 16, 2004

(54) PRESSURE CONTROLLED INK JET PRINTHEAD ASSEMBLY

(75) Inventors: John R. Fowler, Nicholasville, KY (US); Timothy L. Howard, Lexington, KY (US); Matthew J. Russell, Stamping Ground, KY (US); Jon B. Whitney, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/465,348

(22) Filed: Jun. 18, 2003

(51) Int. Cl.[7] ..... B41J 2/175
(52) U.S. Cl. ..... 347/86; 347/85; 347/87
(58) Field of Search ..... 347/85, 86, 87, 347/49

(56) References Cited

U.S. PATENT DOCUMENTS

| | | | | |
|---|---|---|---|---|
| 2,609,570 | A | 9/1952 | Danielson et al. | |
| 3,940,773 | A | 2/1976 | Mizoguchi et al. | 347/68 |
| 4,303,929 | A | 12/1981 | Blanck | 347/86 |
| 4,336,544 | A | 6/1982 | Donald et al. | 347/54 |
| 4,380,018 | A | 4/1983 | Andoh et al. | 347/68 |
| 4,385,025 | A | 5/1983 | Salerno et al. | |
| 4,462,428 | A | 7/1984 | Guenther et al. | 137/868 |
| 4,480,259 | A | 10/1984 | Kruger et al. | 347/63 |
| 4,604,633 | A | 8/1986 | Kimura et al. | 347/7 |
| 4,641,154 | A | 2/1987 | Mikalsen | 347/88 |
| 4,685,185 | A | 8/1987 | Boso et al. | 29/890.1 |
| 4,734,706 | A | 3/1988 | Le et al. | 347/71 |
| 4,734,711 | A | 3/1988 | Piatt et al. | 347/17 |
| 4,860,787 | A | 8/1989 | Grosselin | 137/487.5 |
| 4,910,529 | A | 3/1990 | Regnault | 347/6 |
| 4,914,453 | A | 4/1990 | Kanayama et al. | 347/86 |
| 5,040,002 | A | 8/1991 | Pollacek et al. | 347/87 |
| 5,126,755 | A | 6/1992 | Sharpe et al. | 347/54 |
| 5,426,459 | A | 6/1995 | Kaplinsky | 399/320 |
| 5,434,603 | A | 7/1995 | Hunt | |
| 5,440,333 | A | 8/1995 | Sykora et al. | |
| 5,448,818 | A | 9/1995 | Scheffelin et al. | |
| 5,451,995 | A | 9/1995 | Swanson et al. | 347/87 |
| 5,464,578 | A | 11/1995 | Salter et al. | |
| 5,515,092 | A | 5/1996 | Swanson et al. | |
| 5,541,632 | A | 7/1996 | Khodapanah et al. | 347/87 |

(List continued on next page.)

*Primary Examiner*—Stephen D. Meier
*Assistant Examiner*—Alfred Dudding
(74) *Attorney, Agent, or Firm*—Luedeka, Neely & Graham, P.C.

(57) ABSTRACT

An ink jet printhead assembly for a pressure controlled ink jet printhead. The assembly includes an ink reservoir made of a first material having a first melting point and having an open top cavity defined by sidewalls, a bottom wall and a peripheral edge. A pressure control structure made of a polymeric material having a second melting point lower than the first melting point is included. The pressure control structure has a first surface, a second surface opposite the first surface, a side surface, and an aperture therein. A sealing structure for forming a liquid tight seal is provided between the sidewalls of the ink reservoir and the side surface of the pressure control structure. A pressure regulating film is attached over the aperture to the first surface of the pressure control structure. A cover is attached to the ink reservoir.

21 Claims, 2 Drawing Sheets

U.S. PATENT DOCUMENTS 5,574,490 A 11/1996 Gragg et al. ..... 347/87
5,583,545 A 12/1996 Pawlowski, Jr. et al. ..... 347/7
5,594,483 A 1/1997 Kaplinsky et al. ..... 347/87
5,610,643 A 3/1997 Kutami et al. ..... 347/54
5,640,186 A 6/1997 Swanson et al.
5,644,341 A 7/1997 Fujii et al. ..... 347/11
5,646,666 A 7/1997 Cowger et al. ..... 347/87
5,650,811 A 7/1997 Seccombe et al. ..... 347/85
5,666,141 A 9/1997 Matoba et al. ..... 347/54
5,719,609 A 2/1998 Hauck et al. ..... 347/85
5,736,992 A 4/1998 Pawlowski, Jr. ..... 347/7
5,737,001 A 4/1998 Taylor ..... 347/85
5,745,137 A 4/1998 Scheffelin et al. ..... 347/85
5,751,319 A 5/1998 Robertson et al. ..... 347/85
5,757,401 A 5/1998 Abe et al. ..... 347/48
5,757,406 A 5/1998 Kaplinsky et al. ..... 347/87
5,771,053 A 6/1998 Merrill ..... 347/86
5,777,647 A 7/1998 Pawlowski, Jr. et al. ..... 347/86
5,781,213 A 7/1998 Ujita et al. ..... 347/86
5,812,163 A 9/1998 Wong ..... 347/68
5,812,168 A 9/1998 Pawlowski, Jr. et al. ..... 347/92
5,821,966 A 10/1998 Schell et al. ..... 347/86
5,825,383 A 10/1998 Abe et al. ..... 347/54
5,838,351 A 11/1998 Weber ..... 347/85
5,844,577 A 12/1998 Pawlowski, Jr. ..... 347/6
5,847,734 A 12/1998 Pawlowski, Jr. ..... 347/86
5,894,316 A 4/1999 Sakai et al. ..... 347/54
5,912,688 A 6/1999 Gragg et al. ..... 347/86
5,923,353 A 7/1999 Boyd et al. ..... 347/85
5,975,686 A 11/1999 Hauck et al. ..... 347/85
5,980,028 A 11/1999 Seccombe ..... 347/85
5,984,463 A 11/1999 Kozmiski et al.
5,992,986 A 11/1999 Gyotoku et al. ..... 347/85
6,000,785 A 12/1999 Sakai et al. ..... 347/54
6,003,984 A 12/1999 Bohorquez et al.
6,007,190 A 12/1999 Murray et al. ..... 347/86
6,010,211 A 1/2000 Betschon ..... 347/86
6,053,607 A 4/2000 Kaplinsky et al.
6,074,043 A 6/2000 Ahn ..... 347/54
6,079,813 A 6/2000 Tuli ..... 347/54
6,084,617 A 7/2000 Balazer ..... 347/86
6,106,180 A 8/2000 Anderka ..... 401/145
6,130,690 A 10/2000 Ahn ..... 347/54
6,130,694 A 10/2000 Beatty ..... 347/85
6,164,744 A 12/2000 Froger et al. ..... 347/7
6,168,267 B1 1/2001 Komplin ..... 347/86
6,172,695 B1 * 1/2001 Liu ..... 347/85
6,183,071 B1 2/2001 Sugimoto et al. ..... 347/85
6,199,977 B1 3/2001 Komplin et al.
6,203,146 B1 3/2001 Pawlowksi, Jr. et al. ..... 347/85
6,206,515 B1 3/2001 Swanson et al. ..... 347/87
6,217,153 B1 4/2001 Silverbrook ..... 347/54
6,217,157 B1 4/2001 Yoshihira et al. ..... 347/65
6,227,654 B1 5/2001 Silverbrook ..... 347/54
6,228,050 B1 5/2001 Olsen et al. ..... 604/93.01
6,231,173 B1 5/2001 Pawlowski, Jr. et al.
6,243,115 B1 6/2001 Baker et al. ..... 347/85
6,243,117 B1 6/2001 Brandon et al.
6,247,791 B1 6/2001 Silverbrook ..... 347/54
6,250,747 B1 6/2001 Hauck ..... 347/86
6,257,699 B1 7/2001 Tracy et al. ..... 347/40
6,257,714 B1 7/2001 Seccombe ..... 347/92
6,260,961 B1 7/2001 Seu et al. ..... 347/87
6,270,204 B1 8/2001 Barrett et al. ..... 347/74
6,273,151 B1 8/2001 Kong ..... 141/18
6,290,348 B1 9/2001 Becker et al. ..... 347/87
6,312,116 B2 11/2001 Underwood et al. ..... 347/86
6,312,615 B1 11/2001 Silverbrook ..... 216/27
6,318,851 B1 11/2001 Hoen et al. ..... 347/92
6,325,354 B1 12/2001 Hoen et al. ..... 251/65
6,328,421 B1 12/2001 Kojima et al. ..... 347/46
6,331,050 B1 12/2001 Nakata et al. ..... 347/65
6,331,054 B1 12/2001 Seu et al. ..... 347/87
6,341,853 B1 1/2002 Scheffelin et al. ..... 347/87
6,364,471 B1 4/2002 Seccombe ..... 347/85
6,365,701 B1 4/2002 Hayashi et al. ..... 528/75
6,371,605 B1 4/2002 Komplin et al.
6,382,784 B2 5/2002 Pawlowski, Jr. et al. ..... 347/85
6,383,436 B1 5/2002 Nishimuro et al.
6,390,603 B1 5/2002 Silverbrook ..... 347/54
6,394,137 B1 5/2002 Kikuchi et al.
6,412,911 B1 7/2002 Hilton et al. ..... 347/49
6,416,165 B1 7/2002 Meyer et al. ..... 347/49
6,422,691 B2 7/2002 Kobayashi et al. ..... 347/86
6,428,140 B1 8/2002 Cruz-Uribe ..... 347/20
6,428,141 B1 8/2002 McElfresh et al. ..... 347/40
6,428,147 B2 8/2002 Silverbrook ..... 347/54
6,460,778 B1 10/2002 Silverbrook ..... 239/102.1
6,478,406 B1 11/2002 Silverbrook ..... 347/54
6,500,354 B1 12/2002 Lee et al. ..... 216/27
6,508,545 B2 1/2003 Dowell et al. ..... 347/85
6,527,357 B2 3/2003 Sharma et al. ..... 347/17
6,536,875 B1 3/2003 Pan ..... 347/54
2001/0006395 A1 7/2001 Pawlowski, Jr. et al. ..... 347/85
2001/0013886 A1 8/2001 Underwood et al. ..... 347/86
2001/0017641 A1 8/2001 Kobayashi et al. ..... 347/85
2001/0019347 A1 9/2001 Hauck ..... 347/86
2001/0030675 A1 10/2001 Kobayashi et al. ..... 347/86
2001/0040612 A1 11/2001 Shimizu ..... 347/86
2002/0008744 A1 1/2002 Otis et al. ..... 347/85
2002/0024573 A1 2/2002 Hoen et al. ..... 347/92
2002/0036680 A1 3/2002 Hall et al. ..... 347/85
2002/0039124 A1 4/2002 Nanjo et al. ..... 347/49
2002/0054194 A1 5/2002 Seccombe ..... 347/86
2002/0080216 A1 6/2002 Dowell et al. ..... 347/85
2002/0105567 A1 8/2002 Yamada et al. ..... 347/87
2002/0145650 A1 10/2002 Pan et al. ..... 347/85
2002/0186284 A1 12/2002 Anma et al. ..... 347/85
2002/0191061 A1 12/2002 Dowell et al. ..... 347/94
2003/0016279 A1 1/2003 Hayashi et al. ..... 347/87
2003/0052944 A1 3/2003 Scheffelin et al. ..... 347/49

* cited by examiner

PRESSURE CONTROLLED INK JET PRINTHEAD ASSEMBLY

FIELD OF THE INVENTION

The invention relates to pressure controlled ink jet printheads and in particular to improved printhead assemblies and to improved methods for assembling ink jet printheads.

BACKGROUND

Ink jet technology continues to be improved in order to increase printing speed and print quality or resolution. One means for improving print speed and quality is to increase the number of nozzle holes in an ink jet printhead and to decrease the diameter of the nozzle holes. However, improvements in print speed and quality often result in operational problems not experienced with lower quality slower speed printers.

In an ink jet printer, ink is provided to the printhead from an ink cartridge or supply tank. The ink flows from the tank through a connecting conduit from the ink cartridge through an ink via in a semiconductor chip or around the edges of a semiconductor chip and into ink flow channels and an ink chamber. The ink chamber is situated in axial alignment with a corresponding nozzle hole and a heater resistor defined on the surface of the semiconductor chip. As electrical impulse energy is applied to an ink ejector adjacent an ink chamber to cause ink adjacent the ejector in the chamber to be forced through a nozzle hole onto a print medium. By selective activation of a plurality of ink ejectors on a printhead, a pattern of ink dots are applied to the print medium to form an image.

A critical aspect of the printing process is the controlled supply of ink to the ink ejectors from the ink supply. If the pressure of the ink supply is too high, ink may run out freely from the nozzle holes onto the print medium before the ink ejector is activated. If the pressure of the ink supply is too low, ink channels and chambers in the printhead will not refill fast enough. If the ink chambers and channels are not refilled fast enough there will be missing ink dots or the print speed must be lowered to allow time for ink to refill the ink chambers. Furthermore, as ink is used from the ink supply, the pressure of the ink supply may decrease to a point which inhibits flow of the remaining ink to the ink ejectors. Accordingly, as the number of nozzles holes on a printhead increases and the diameter of the holes decreases, maintaining a predetermined ink supply pressure in the ink supply system becomes more critical.

There are two primary methods for maintaining ink supply flow to printheads. The first method includes the use of a porous capillary member such as foam which is saturated with ink and provides a controlled flow of ink to the printheads. The second method includes the use of a diaphragm or bellows to provide pressure or back pressure on the ink in the cartridge. Use of a diaphragm or bellows enables an ink supply reservoir to be filled with liquid ink as opposed to the use of foam saturated with ink. Accordingly, the ink jet printhead assembly may be made smaller for the same volume of ink ejected onto the print media during the life of the printhead. One disadvantage of smaller ink jet printhead assemblies which use a diaphragm or bellows for pressure control is that manufacturing techniques become more complicated because of a greater number of different materials required for use in the printhead assembly.

There is a need therefore for an improved pressure controlled ink supply assembly and improved methods for assembling pressure controlled ink jet printheads.

SUMMARY OF THE INVENTION

With regard to the foregoing and other objects and advantages, the invention provides an ink jet printhead assembly for a pressure controlled ink jet printhead. The assembly includes an ink reservoir having an open top cavity defined by sidewalls, a bottom wall and a peripheral edge. The ink reservoir is made of a first material having a first melting point. A pressure control structure having a first surface, a second surface opposite the first surface, a side surface, and an aperture extending therethrough from the first surface to the second surface is also provided. The pressure control structure is made of a polymeric material having a second melting point lower than the first melting point. A sealing structure is provided for forming a liquid tight seal between the sidewalls of the ink reservoir and the side surface of the pressure control structure. A pressure regulating film is attached to the first surface of the pressure control structure closing the aperture therein. A cover is attached to the ink reservoir to protect the pressure regulating film from damage.

In another embodiment, the invention provides method for assembling a pressure controlled ink jet printhead assembly. The method includes providing an ink reservoir having an open top cavity defined by sidewalls, a bottom wall and a peripheral edge. The ink reservoir is made of a first material having a first melting point. A pressure control structure having a first surface, a second surface opposite the first surface, a side surface, and an aperture extending therethrough from the first surface to the second surface is also included. The pressure control structure is made of a polymeric material having a second melting point lower than the first melting point. A sealing structure is applied to the side walls of the pressure control structure for forming a liquid tight seal between the sidewalls of the ink reservoir and the side surface of the pressure control structure. The pressure control structure is inserted in the open top cavity of the ink reservoir. A pressure regulating film is attached to the first surface of the pressure control structure thereby closing the aperture therein. A cover is attached to the ink reservoir to protect the pressure regulating film from damage.

The invention provides a number of advantages over conventional ink jet printhead assemblies. For one, components of the assembly may be sub assembled and combined using only mechanical means. Also, there is no need for use of a two step injection molding process to provide inner and outer frames made of different materials. Another advantage of the invention is that the components may be assembled with a high degree of assurance of substantially no ink leakage from the assembled components. Also, a pressure control film may be made of a single material rather than from a laminate construction of two or more different materials thereby improving the pressure control response of the assembly.

BRIEF DESCRIPTION OF THE DRAWINGS

The above and other aspects and advantages of the invention will become further apparent by reference to the following detailed description of preferred embodiments when considered in conjunction with the accompanying drawings in which.

DETAILED DESCRIPTION OF THE PREFERRED EMBODIMENTS

Figure 1:
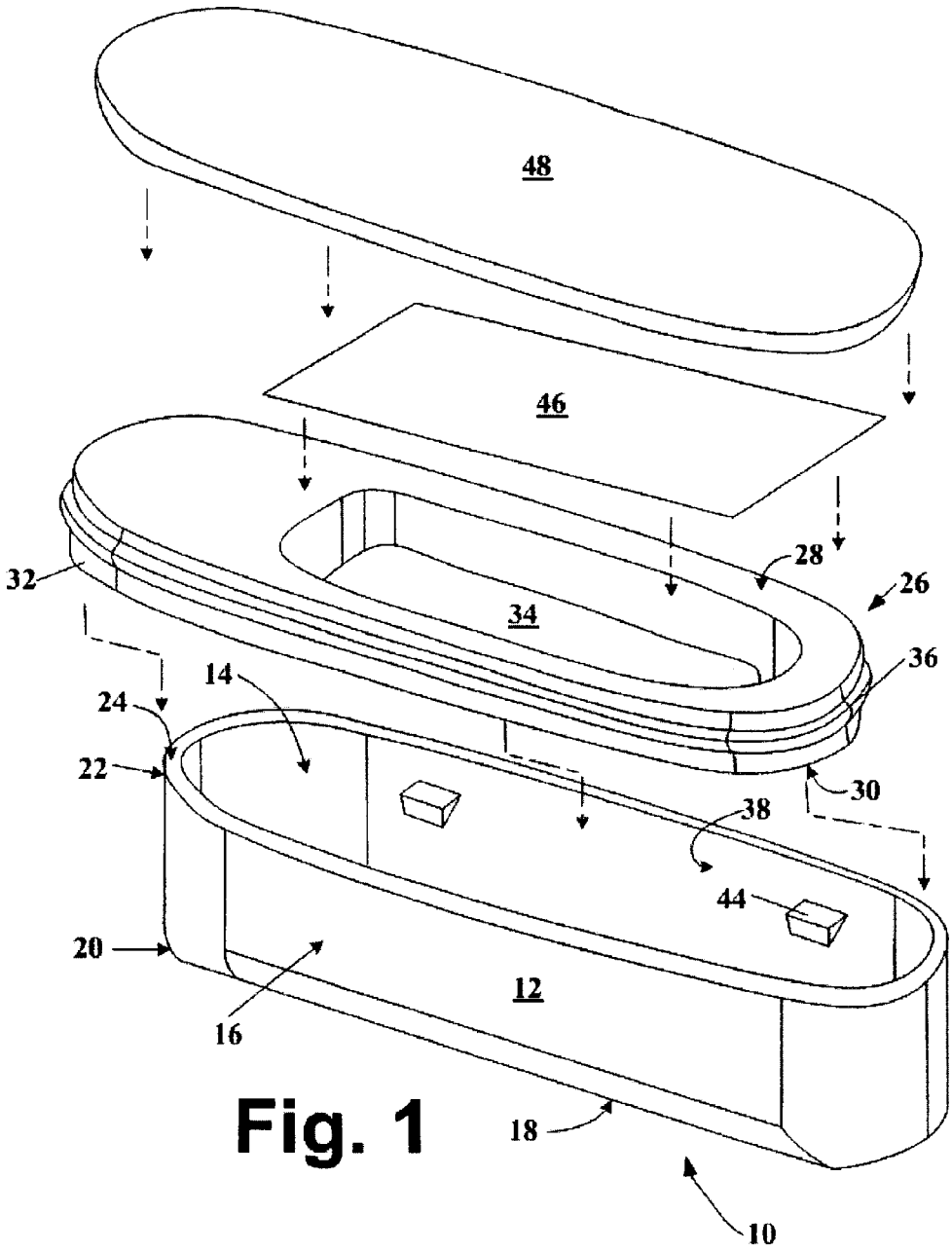
FIG. 1 is an exploded, perspective view, not to scale, of a printhead assembly according to the invention.

With reference to FIG. I there is provided an exploded view in perspective of an ink jet printhead assembly 10 according to a preferred embodiment of the invention. The assembly 10 includes a substantially rectangular-shaped ink reservoir 12 having an open top cavity 14 defined by side walls 16 surrounding the cavity 14. A bottom wall 18 is connected to a first end 20 of the side walls 16. A second end 22 of the side walls 16 contains a peripheral edge 24.

The ink reservoir 12 component of the assembly is preferably made of a first material having a first melting point. The first material may include metals, plastics, glass, ceramics, and composites of two or more of the foregoing. More preferably the ink reservoir 12 is molded from a material selected from the group consisting of thermoplastic materials including but not limited to polyphenylene oxide/polystyrene alloys, polypropylene, acrylonitrile/butadiene/styrene terpolymers, polystyrene/butadiene alloys or copolymers, polyetherimide, polysulfone, polyesters and the like, having a melting point or softening point above about 150° C. A particularly preferred material for ink reservoir 12 is a polyphenylene ether/polystyrene resin from GE Plastics of Pittsfield, Mass. under the trade name NORYL SE1701.

An important component of the printhead assembly is a pressure control structure 26. The pressure control structure 26 has a first surface 28 and a second surface 30 opposite the first surface and a side surface 32 around the periphery thereof. An aperture 34 extends through the pressure control structure 26 from the first surface 28 to the second surface 30.

Unlike the ink reservoir 12, the pressure control structure 26 is preferably made of a polymeric material, preferably a thermoplastic material having a second melting point lower than the first melting point. Suitable materials for the pressure control structure 26 include materials selected from polypropylene and polyethylene materials. The most preferred material is polyethylene material having a melting point of about 120° C.

As will be described in more detail below, a flexible film is preferably melt attached to the pressure control structure 26. Accordingly, making the pressure control structure 26 from a material that enables melt attachment of a film thereto improves the manufacturing process for the assembly 10. It is also important that the ink reservoir 12 be made of a higher melting material than the pressure control structure 26. Such a higher melting material is less susceptible to warping and deformation due to high printhead temperatures during printing operations.

A sealing structure 36 is provided on side surface 32 for forming a liquid tight and air tight seal between the inner surface 38 of side walls 16 and the side surface 32 of the pressure control structure 26. The sealing structure 36 preferably provides a liquid tight and air tight seal by purely mechanical means. Accordingly the sealing structure 36 may be selected from elastomeric materials and adhesives. A particularly preferred sealing structure 36 is an elastomeric o-ring made from ethylene propylene diene monomer (EPDM). Regardless of whether the sealing structure 36 is an adhesive or elastomeric o-ring material, it is preferred that the sealing structure 36 be substantially chemically resistant to the components of ink used in the printhead assembly 10.

Figure 2:
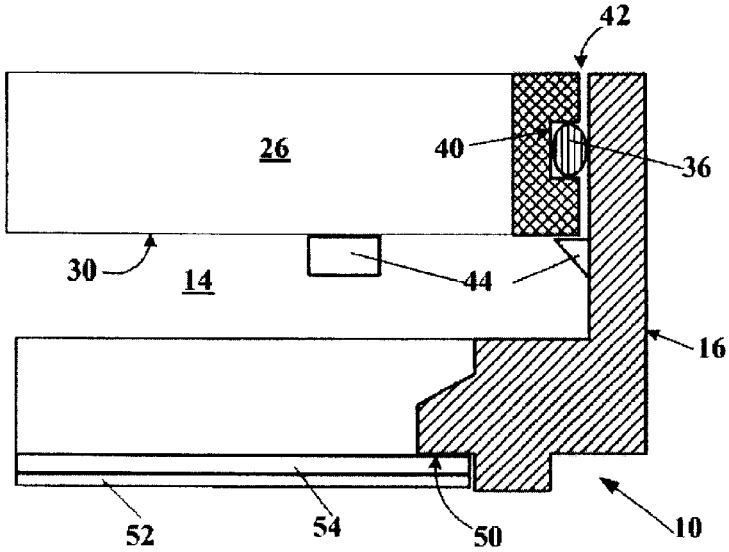
FIG. 2 is a cross-sectional view, not to scale, of a portion of a printhead assembly according to the invention.

As shown in more detail in FIG. 2, the pressure control structure 26 preferably includes a peripheral groove 40 in the side surface 32 thereof. The groove 40 is preferably dimensioned to accept an o-ring or bead of adhesive as the sealing structure 36. Because the sealing structure 36 provides a liquid tight and air tight seal between the side surface 32 and the inner surface 38 of side walls 16, each of the major components 12 and 26 may be separated formed or molded from different materials. Also, tolerances between the inner surface 38 of side walls 16 and the side surface 32 of the pressure control structure 26 are less critical because the sealing structure 36 is capable of spanning any gap 42 between the two. In order to improve assembly between the pressure control structure 26 and the ink reservoir 12, stops 44 or a ledge may be provided to limit the distance the pressure control structure can be moved into the cavity 14.

A pressure regulating film 46 is preferably attached to the first surface 28 of the pressure control structure 26 to close or otherwise cover the aperture 34 in the pressure control structure 26. The pressure regulating film 46 may be made from a wide variety of materials including, but not limited to, films that are compatible with the inks used in the ink printhead assembly 10 and films adaptable to welding or adhesive attachment thereof to the first surface 28 of the pressure control structure 26. Such films include polyethyelene films and polypropylene films having a thickness ranging from about 1.5 to about 3 mils.

A particularly preferred film 46 is for controlling pressure in the assembly 10 is a copolymer polypropylene material available from Triangle Plastics of Raleigh, N.C. under the trade name CPP40. The copolymer polypropylene material may be laminated with an adhesive available from Minnesota Mining and Manufacturing Company of Minneapolis, Minn. under the trade name 3M-845. It is preferred however, to use a non-laminated film 46 that is capable of being heat welded to the first surface 28 of the pressure control structure 26. Heat welding of the film 46 to the surface 28 may be accomplished by providing a pressure control structure 26 made from a polymeric material having a similar melting point to that of the film 46 or having a lower melting point than the melting point of the film 46. In a particularly preferred embodiment, the film 46 is preferably selected from a material having substantially the same melting point as that of the material of the pressure control structure 26.

A cover 48 is preferably attached to the ink reservoir 12 to protect the film 46 from damage and to provide additional sealing between the ink reservoir 12 and the pressure control structure 26. The cover 48 may be heat welded, adhesively attached or snap fit to the ink reservoir 12. In a preferred embodiment, the cover 48 is adhesively attached to the peripheral edge of the ink reservoir 12.

Figure 3:
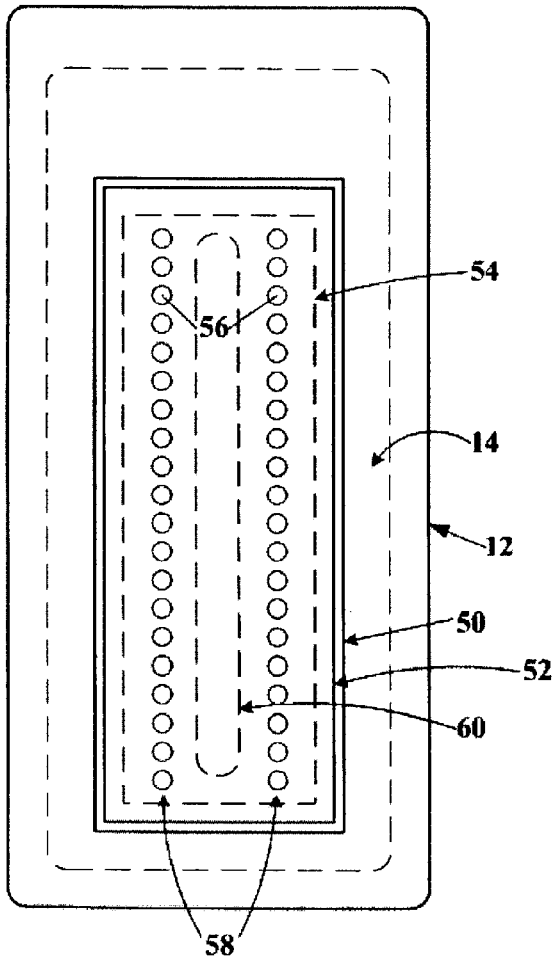
FIG. 3 is a bottom plan view, not to scale, of a printhead assembly according to the invention.

A bottom wall 18 of the ink reservoir 12 preferably includes a pocket or recessed area 50 for attaching a nozzle plate 52 and semiconductor chip 54 thereto (FIGS. 2 and 3). The nozzle plate 54 preferably includes a plurality of nozzle holes 56 for ejection of ink therethrough toward a print media. The nozzle holes 56 may be provide in one or more arrays 58 along the length of the nozzle plate 52. An ink feed via 60 in the chip 54 provides a flow of ink to ink ejectors on the chip 54. The ink ejectors may be selected from thermal or electromechanical type ejectors including heater resistors and piezoelectric devices.

Because the pressure regulating structure 26 and ink reservoir 12 components of the assembly 10 may be made separately from different materials, assembly of the components to provide the printhead assembly 10 can be achieved in a variety of ways. For example, the film 46 may be attached to the first surface 28 of the pressure control structure 26 prior to inserting the pressure control structure 26 into the cavity 14 of the ink reservoir 12. In the alternative, the pressure regulating structure 26 may be inserted into the cavity 14 of the ink reservoir 12 before attaching the film 46 to the first surface 28 of the pressure control structure 26. Either method will provide an improved pressure controlled ink jet printhead assembly 10 according to the invention.

Ink is preferably inserted into cavity 14 before attaching the film 46 to the pressure control structure 26 when the pressure control structure 26 is first inserted into cavity 14. If the film is first attached to the pressure control structure 26 before the pressure control structure is inserted into cavity 14, then the ink is inserted into the cavity 14 before inserting the pressure control structure 26 into cavity 14.

After the cavity 14 is filled with ink, and the cover 48 is attached to the ink reservoir 12, a reduced pressure or back pressure is applied to the cavity 14, preferably through an opening in the ink reservoir 12, to provide a predetermined pressure differential between cavity 14 and the nozzle plate/chip assembly 52/54. As ink is ejected through the nozzle holes 56, the volume of ink in cavity 14 decreases. The pressure regulator structure 26 and film 46 are effective to maintain a predetermined pressure in cavity 14 as the volume of ink in the cavity decreases. The pressure regulator structure 26 and film 46 also helps to compensate for pressure changes in ink cavity 14 due to ambient temperature and pressure changes. In most instances, the predetermined minimum pressure or back pressure maintained in the cavity 14 ranges from about −8 to about −24 centimeters (cm) of water.

In a particularly preferred embodiment, a biasing device such as a coil spring, leaf spring, resilient foam or the like is included in the pressure cavity 14 to bias the film 46 away from the bottom wall 18 of the ink reservoir 12 in order to maintain a predetermined pressure on ink in the reservoir 12. In an alternative embodiment, the biasing device may be disposed between the cover 48 and the film 46 to bias the film 46 toward the bottom wall 18 of the ink reservoir 12 in order to maintain a predetermined pressure in the reservoir 12.

The foregoing description of certain exemplary embodiments of the present invention has been provided for purposes of illustration only, and it is understood that numerous modifications, alterations, substitutions, or changes may be made in and to the illustrated embodiments without departing from the spirit and scope of the invention.

What is claimed is:

1. An ink jet printhead assembly for a pressure controlled ink jet printhead comprising:

an ink reservoir having an open top cavity defined by sidewalls, a bottom wall and a peripheral edge, the ink reservoir being made of a first material having a first melting point;

a pressure control structure having a first surface, a second surface opposite the first surface, a side surface, and an aperture extending therethrough from the first surface to the second surface, the pressure control structure being made of a polymeric material having a second melting point lower than the first melting point;

a sealing structure for forming a liquid tight seal between the sidewalls of the ink reservoir and the side surface of the pressure control structure;

a pressure regulating film attached to the first surface of the pressure control structure closing the aperture therein; and a cover attached to the ink reservoir to protect the pressure regulating film from damage.

2. The ink jet printhead assembly of claim 1 wherein the side surface of the pressure control structure further comprises a peripheral groove.

3. The ink jet printhead assembly of claim 2 wherein the sealing structure comprising an elastomeric o-ring disposed in the peripheral groove.

4. The ink jet printhead assembly of claim 2 wherein the sealing structure comprises a bead of adhesive disposed in the peripheral groove.

5. The ink jet printhead assembly of claim 1 wherein the sealing structure comprising an elastomeric o-ring.

6. The ink jet printhead assembly of claim 1 further comprising a semiconductor substrate and nozzle plate attached to the bottom wall of the ink reservoir.

7. The ink jet printhead assembly of claim 1 wherein the pressure regulating film is melt attached to the first surface of the pressure control structure.

8. A method for assembling a pressure controlled ink jet printhead assembly comprising:

providing an ink reservoir having an open top cavity defined by sidewalls, a bottom wall and a peripheral edge, the ink reservoir being made of a first material having a first melting point; and a pressure control structure having a first surface, a second surface opposite the first surface, a side surface, and an aperture extending therethrough from the first surface to the second surface, the pressure control structure being made of a polymeric material having a second melting point lower than the first melting point;

applying a sealing structure to the side walls of the pressure control structure for forming a liquid tight seal between the sidewalls of the ink reservoir and the side surface of the pressure control structure;

inserting the pressure control structure in the open top cavity of the ink reservoir;

attaching a pressure regulating film to the first surface of the pressure control structure thereby closing the aperture therein; and attaching a cover to the ink reservoir to protect the pressure regulating film from damage.

9. The method of claim 8 wherein the side surface of the pressure control structure further comprises a peripheral groove.

10. The method of claim 9 wherein the sealing structure comprising an elastomeric o-ring, and wherein the step of applying the sealing structure comprises disposing the o-ring in the peripheral groove.

11. The method of claim 9 wherein the sealing structure comprises a bead of adhesive and wherein the step of applying the sealing structure comprises disposing the adhesive in the peripheral groove.

12. The method of claim 8 wherein the sealing structure comprising an elastomeric o-ring.

13. The method of claim 8 further comprising attaching a semiconductor substrate and nozzle plate to the bottom wall of the ink reservoir.

14. The method of claim 8 wherein the step of attaching the pressure regulating film comprises melt attaching the film to the first surface of the pressure control structure.

15. A method for assembling a pressure controlled ink jet printhead assembly comprising:

providing an ink reservoir having an open top cavity defined by sidewalls, a bottom wall and a peripheral edge, the ink reservoir being made of a first material having a first melting point; and a pressure control structure having a first surface, a second surface opposite the first surface, a side surface, and an aperture extending therethrough from the first surface to the second surface, the pressure control structure being made of a polymeric material having a second melting point lower than the first melting point;

applying a sealing structure to the side walls of the pressure control structure for forming a liquid tight seal between the sidewalls of the ink reservoir and the side surface of the pressure control structure;

attaching a pressure regulating film to the first surface of the pressure control structure thereby closing the aperture therein;

inserting the pressure control structure in the open top cavity of the ink reservoir; and attaching a cover to the ink reservoir to protect the pressure regulating film from damage.

16. The method of claim 15 wherein the side surface of the pressure control structure further comprises a peripheral groove.

17. The method of claim 16 wherein the sealing structure comprising an elastomeric o-ring, and wherein the step of applying the sealing structure comprises disposing the o-ring in the peripheral groove.

18. The method of claim 16 wherein the sealing structure comprises a bead of adhesive and wherein the step of applying the sealing structure comprises disposing the adhesive in the peripheral groove.

19. The method of claim 15 wherein the sealing structure comprising an elastomeric o-ring.

20. The method of claim 15 further comprising attaching a semiconductor substrate and nozzle plate to the bottom of the ink reservoir.

21. the method of claim 15 wherein the step of attaching the pressure regulating film comprises melt attaching the film to the first surface of the pressure control structure.

* * * * *